US005679079A

United States Patent [19]

Crosby et al.

[11] Patent Number: 5,679,079

[45] Date of Patent: Oct. 21, 1997

[54] SOLID STATE BOWLING PIN COUNTER AND METHOD THEREFOR

[76] Inventors: Kennith D. Crosby, 10199 E. Sweetwater, Scottsdale, Ariz. 85260; William J. Tuten, 8708 E. Malcomb Dr., Scottsdale, Ariz. 85253

[21] Appl. No.: 545,950

[22] Filed: Oct. 23, 1995

[51] Int. Cl.[6] ..... A63D 5/00

[52] U.S. Cl. ..... 473/70; 473/64; 473/101; 340/323

[58] Field of Search ..... 473/64–65, 69–71, 473/101, 94, 95; 364/410–411, 478, 479; 340/323 B, 323 R; 250/215, 216, 226; 209/552, 576, 577, 580, 581, 582; 356/402, 425, 432, 433, 434, 435, 445, 448

[56] References Cited

U.S. PATENT DOCUMENTS

| | | | |
|---|---|---|---|
| 3,300,213 | 1/1967 | Miller | 473/101 |
| 3,307,848 | 3/1967 | Brackett et al. | 473/101 |
| 3,309,086 | 3/1967 | Viets et al. | 473/101 |
| 3,582,071 | 6/1971 | Grosvenor | 473/70 |
| 3,651,328 | 3/1972 | Hutto, Jr. et al. | 473/69 |
| 3,795,402 | 3/1974 | Bolger et al. | 473/101 |
| 3,804,408 | 4/1974 | Saito et al. | 473/101 |
| 3,825,749 | 7/1974 | Gautraud et al. | 473/65 |
| 3,847,394 | 11/1974 | Logemann, Jr. et al. | 473/101 |
| 4,726,587 | 2/1988 | Fitch | 473/101 |
| 4,776,702 | 10/1988 | Yamaba | 356/425 |
| 4,827,412 | 5/1989 | Form | 473/101 |
| 4,863,041 | 9/1989 | Bailey | 356/425 |
| 4,917,500 | 4/1990 | Lugos | 356/425 |
| 5,115,125 | 5/1992 | Biggs | 473/101 |
| 5,158,181 | 10/1992 | Bailey | 209/581 |
| 5,226,648 | 7/1993 | Nogami | 473/73 |
| 5,241,379 | 8/1993 | Tsujita | 364/411 |
| 5,579,921 | 12/1996 | Mallant et al. | 209/580 |

*Primary Examiner*—Jessica Harrison
*Assistant Examiner*—Mark A. Sager
*Attorney, Agent, or Firm*—Harry M. Weiss; Jeffrey D. Moy; Harry M. Weiss & Associates, P.C.

[57] ABSTRACT

The present invention relates to a solid state bowling pin counter which is designed to replace existing mechanical pin counters. The solid state pin counter uses infrared technology and electro-optics to reliably detect the presence of a bowling pin as the pin travels towards the bowling pin table via the distributor assembly. The solid state pin counter can detect all colors of bowling pins and it works reliably in all ambient light conditions including flashing lights. If power is turned off during the time bowling pins are being fed into the bowling pin table, the memory in the pin counter remembers the pin counter's condition no matter where the bowling pin is on the distributor belt. Thus, when power is turned back on, the bowling pin table is filled with bowling pins as if the power was never turned off.

23 Claims, 3 Drawing Sheets

SOLID STATE BOWLING PIN COUNTER AND METHOD THEREFOR

BACKGROUND OF THE INVENTION

1. Field of the Invention

This invention relates generally to a counting device and, more specifically, to a bowling pin counter which uses electro-optical technologies, such as infrared transmitters and detectors, for counting the bowling pins as the bowling pins are routed into the appropriate spotting cups in the pinspotter table through the use of a distributor arm.

2. Description of the Prior Art

Currently, there are many different types of bowling lane pinspotters that are used in the marketplace. The primary manufacturers of bowling lane pinspotters are AMF and Brunswick who together manufacture approximately 90 percent of all bowling lane pinspotters. Both of these companies have been in business for many years and, as a direct result of this, many different versions of these companies' pinspotters exist in the marketplace. Specifically, there are three main models of pinspotters: the early 8230 pinspotter with a 4400 system, the 8230 pinspotter with a 5850 chassis and the 8230 pinspotter with a 6525 chassis. The combination of all three of these types of pinspotters is over 30,000 units.

Early AMF designs (i.e., early 1950's) used a mechanical pin counter to control the number of pins that were placed into the bowling pin table at any one time. These mechanical counters are still being used with the above mentioned pinspotters. The mechanical pin counter operates by moving a lever arm which moves a paul mechanism that causes the rotation of the pin counter one position. While these mechanical counters do work, they are very unreliable because of the tedious mechanical adjustments that need to be made due to the harsh conditions of the bowling lanes (i.e., dirt). Furthermore, many of these mechanical counters are very old and, in most cases, completely worn out.

Therefore, a need existed to provide an improved bowling pin counter. The improved bowling pin counter would not require tedious maintenance nor would it be susceptible to the harsh conditions of the bowling lanes and its equipment. The improved bowling pin counter would be an electro-optical counter that could detect and count the different color bowling pins that may be used during special events at the bowling alley. The improved electro-optical bowling pin counter would also not be susceptible to variations in the light level near the pin counter.

SUMMARY OF THE INVENTION

In accordance with one embodiment of the present invention, it is an object of the present invention to provide an improved bowling pin counter.

It is another object of the present invention to provide an improved bowling pin counter that would not require tedious maintenance and adjustments and that would not be susceptible to the harsh conditions of the bowling lanes and its equipment.

It is still another object of the present invention to provide an improved bowling pin counter that would be an electro-optical type counter that could detect and count the different color bowling pins that may be used during special events at the bowling alley.

It is a further object of the present invention to provide an improved electro-optical type bowling pin counter that would not be susceptible to variations in the light level near the pin counter.

BRIEF DESCRIPTION OF THE PREFERRED EMBODIMENTS

In accordance with one embodiment of the present invention, a bowling pin counter that can detect and count bowling pins regardless of the color of the bowling pins is disclosed. The bowling pin counter is comprised of transmitter means for transmitting short pulses of infrared emissions to detect the bowling pins. Receiving means are coupled to the transmitter means for receiving the reflected pulses of infrared emissions when the bowling pins are positioned in front of the transmitter means. The receiving means are also used for amplifying the reflected pulses of infrared emissions to allow for the detection of colored bowling pins that may have reflected wavelengths that are lower than wavelengths of the transmitted short pulses of infrared emissions. Processing means are coupled to the receiving means for stretching the amplified reflected pulses to provide an output signal for as long as the reflected pulses are received. The output signal also sets a latch mechanism which prevents the bowling pins from being counted prior to a present bowling pin moving away from the transmitter means. The latching mechanism also prevents small objects from falsely triggering the receiving means. Counter/memory means are coupled to the processing means for counting the bowling pins by detecting the output signal from the processing means. The counter/memory means resets itself to zero after a predetermined number of bowling pins has been detected. Output means are coupled to the counter/memory means for receiving a signal from the counter/memory means when the predetermined number of bowling pins has been detected and for placing the bowling pin counter in a static condition once the predetermined number of bowling pins has been detected. Power supply means are coupled to the transmitter means, the receiving means, the processing means, the counter/memory means, and the output means for converting an inputted power source Voltage Alternating Current (VAC) to an operating Voltage Direct Current (VDC) for use by the electronics mentioned above.

In accordance with another embodiment of the present invention, a method of providing a bowling pin counter that can detect and count bowling pins regardless of color is disclosed. The method comprises the steps of: providing transmitter means for transmitting short pulses of infrared emissions to detect the bowling pins; providing receiving means coupled to the transmitter means for receiving the reflected pulses of infrared emissions when the bowling pins are positioned in front of the transmitter means and for amplifying the reflected pulses of infrared emissions to allow detection of colored bowling pins that may have reflected wavelengths that are lower than wavelengths of the transmitted short pulses of infrared emissions; providing processing means coupled to the receiving means for stretching the amplified reflected pulses to provide an output signal for as long as the reflected pulses are received, the output signal setting a latch mechanism which prevents the bowling pins from being counted prior to a present bowling pin moving away from the transmitter means and which prevents small objects from falsely triggering the receiving means; providing counter/memory means coupled to the processing means for counting the bowling pins by detecting the output signal from said processing means, the counter/memory means resetting to zero once a predetermined number of bowling pins has been detected; providing output means coupled to the counter/memory means for receiving a signal from the counter/memory means when the predetermined number of bowling pins has been detected and for placing the bowling pin counter in a static condition once the predetermined number of bowling pins has been detected; and providing power supply means coupled to the transmitter means, the receiving means, the processing means, the counter/memory means, and the output means for converting an inputted power source Voltage Alternating Current (VAC) to an operating Voltage Direct Current (VDC) (about 5.5 VDC) for use by the above mentioned electronic components.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
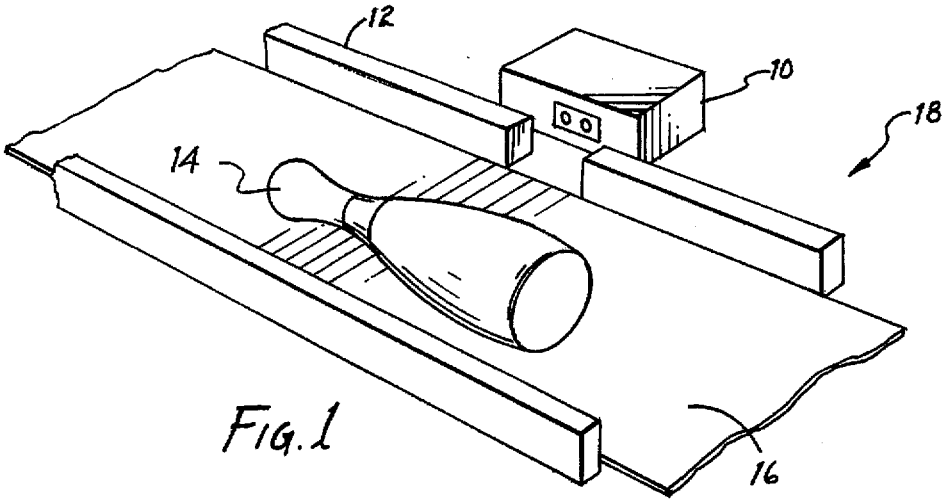
FIG. 1 depicts the solid state bowling pin counter of the present invention being used on a bowling lane.

Referring to FIG. 1, a solid state bowling pin counter (hereinafter pin counter) 10 is shown. The pin counter 10 is attached to the distributor arm 12 of the bowling lane 18. The pin counter 10 is mounted so that it can detect bowling pins 14 as they move down the distributor belt 16. The distributor belt 16 is driven by a motor (not shown), and the bowling pin flow is controlled by a bowling pin feed solenoid (not shown) which allows the bowling pins 14 to be placed on the distributor belt 16 for counting and distribution. Once ten bowling pins 14 have been detected, an output signal from the pin counter 10 is sent to the chassis (not shown) which turns off the pin feed solenoid.

Figure 2:
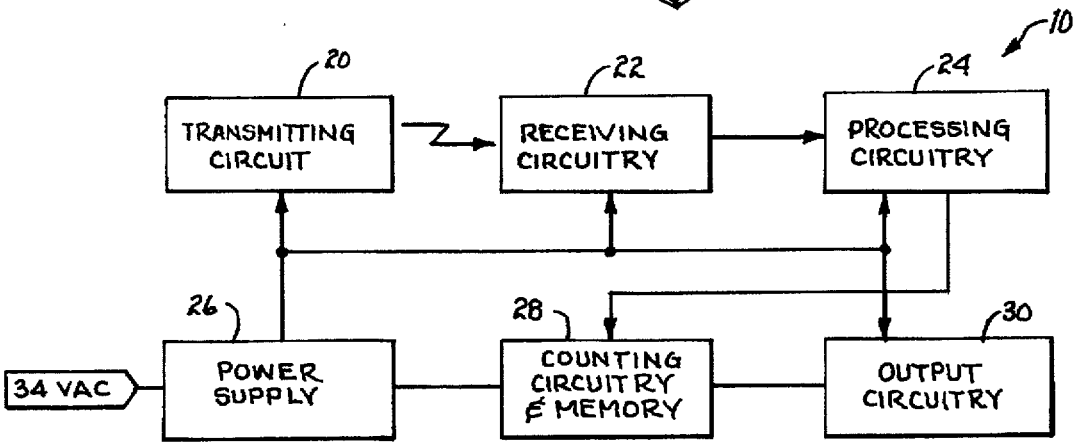
FIG. 2 is a simplified block diagram of the solid state bowling pin counter shown in FIG. 1.

Referring to FIG. 2, a simplified block diagram of one implementation of the pin counter 10 is shown. As shown in FIG. 2, the pin counter 10 consist of a transmitter 20, a receiver 22, a processor 24, a power supply 26, a counter/memory circuit 28, and an output driver 30. The transmitter 20 produces short pulses of electromagnetic energy, specifically high energy infrared emissions. The pulses are about 23 microseconds in length and have a pulse repetition rate of about 200 pulses per second. The transmitter 20 sends the pulses at a slight angle so that the focal point is approximately in the middle of the distribution belt 16 (see FIG. 1) which is about 3.5 inches to about 4 inches from the pin counter 10. When a bowling pin 14 (see FIG. 1) is positioned in front of the pin counter 10, the infrared emissions are reflected back towards the pin counter 10. The receiver 22 detects the reflected emissions and amplifies the signal. The bandwidth of the receiver 22 has a 50 percent crossover sensitivity that ranges from 700 nanometers to 1000 nanometers. The center of the transmitted pulses is 940 nanometers. Thus, the receiver 22 allows for the detection of colored bowling pins 14 that have a reflected wavelength that is lower than the transmitted wavelength. The amplified signal is then sent to the processor 24 where the signal is then stretched. The detected pulses are stretched sufficiently to provide a DC output signal for as long as a reflected signal is detected by the receiver 22. The DC output signal is then converted to a 100 microsecond pulse which is fed into the counter/memory circuit 28. The leading edge of the pulse is used by the counter/memory circuit 28 for counting the number of detected bowling pins 14. The trailing edge of the pulse is used by the processor 24 to set a latching mechanism. The latching mechanism prevents bowling pins 14 from being counted prior to a present bowling pin 14, which is positioned in front of the pin counter 10, moving away from the front of the pin counter 10. The latch mechanism also prevents small objects from falsely triggering the receiver 22. Once ten bowling pins 14 have been detected, the output driver 30 places the bowling pin counter 10 in a static condition. A power supply 26 is provided to convert an incoming power source (i.e, Voltage Alternating Current (VAC)) to an operating voltage (i.e., Voltage Direct Current (VDC)) for use by the electrical components listed above. In the preferred embodiment of the present invention, the power supply 26 converts an incoming power source to 5.5 VDC. The power supply 26 also supplies a memory capacitor (28B in FIG. 6) with power. The memory capacitor 28B provides power to the counter/memory circuit 28 so as to store the contents of the counter/memory circuit 28 when power is turned off to the pin counter 10.

Figure 6:
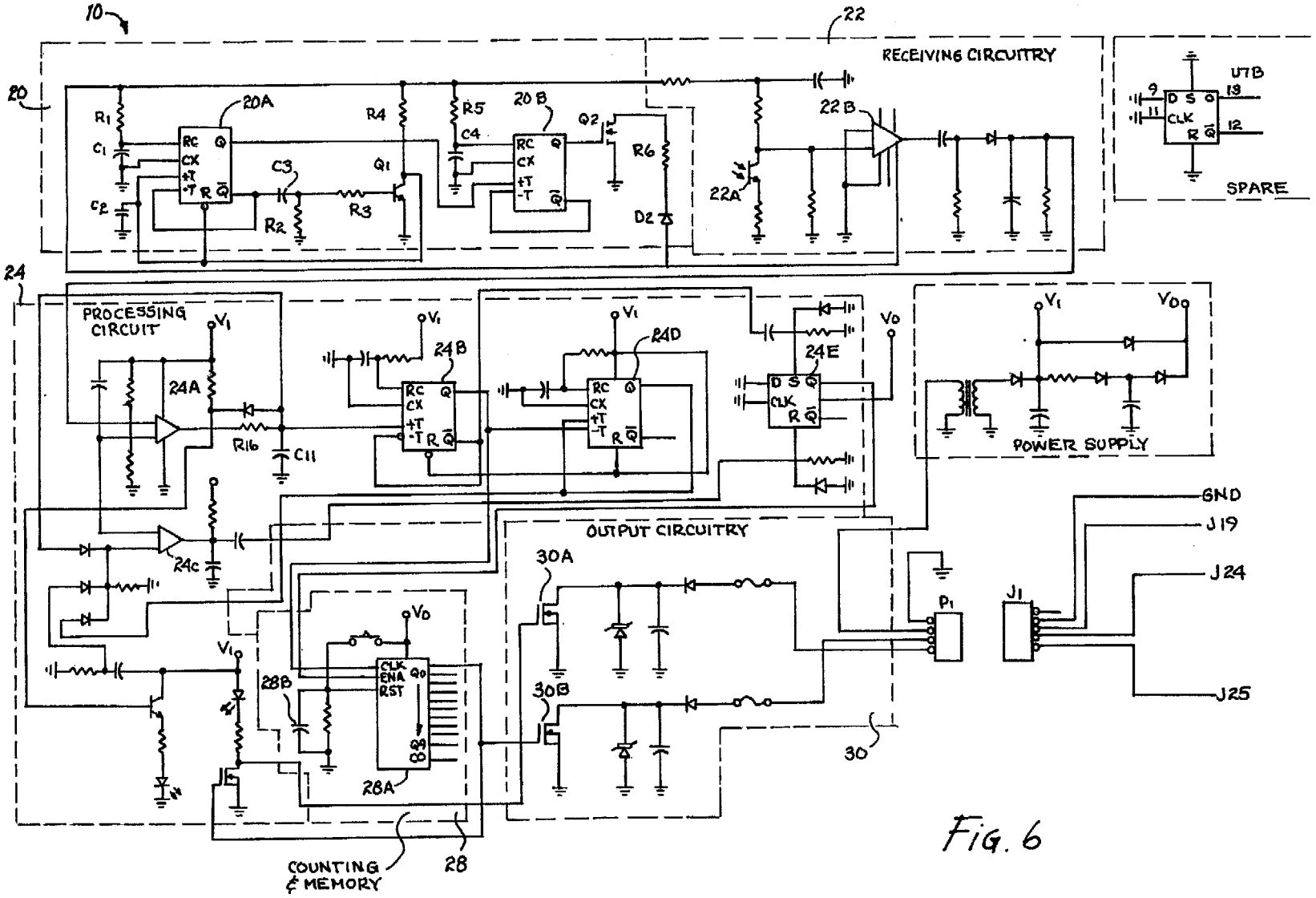
FIG. 6 is a detailed schematic of one implementation of the solid state bowling pin counter shown in FIG. 1.

Referring to FIG. 6, a detailed schematic of one embodiment of the pin counter 10 is shown. The transmitter 20 is comprised of a pulse generator which consist of a dual monostable multivibrators 20A, 20B; two monostable timing networks (R1/C1 and R5/C5); and a delay re-triggering network (C3, R2, R3, Q1, R4, and C2). The first half of the dual monostable multivibrator 20A produces a pulse that immediately triggers the second half of the dual monostable multivibrator 20B. The second half of the dual monostable multivibrator 20B produces a drive pulse for a high power drive circuit. When the pulse to the first half of the dual monostable multivibrator 20A is over an output from first half of the dual monostable multivibrator 20A, pin 7 of the first half of the dual monostable multivibrator 20A, which is coupled to a capacitor C3, differentiates between the leading edges. This pulse created by the differentiation turns on a transistor Q1. The output of Q1 goes low and stays low as long as the input pulse to the transistor Q1 is present. The length of this time is based upon the value of the capacitor C3 and the parallel combination of the resistors R2 and R3. When the transistor Q1 turns off, its output goes high causing the first half of the monostable multivibrator 20A to be re-triggered. This process continues for as long as power is applied. The output of the second half of the monostable multivibrator 20B drives the gate of a power Field Effect Transistor (FET) Q2. When the output of the second half of the monostable multivibrator 20B is high, the FET Q2 is turned on and a power pulse is coupled through emitting diode D2 to produce an infrared emission.

When a bowling pin 14 comes in front of the pin counter 10, the infrared emissions will be reflect back to the receiver 22. The receiver 22 detects the reflected pulses with a photo transistor 22A. The photo transistor 22A takes the reflected pulses and sends them to an amplified 22B where the pulses are amplified.

The resulting amplified signal is sent to a threshold detector 24A of the processor 24. When the amplified signal is greater than the preset threshold value, the output of the threshold detector 24A goes high and the capacitor C11 is charged through resistor R16. The integrated signal formed by this process is sent to a monostable multivibrator 24B and to a comparator 24C. The signal disables the comparator 24C and triggers on the monostable multivibrator 24B. The output of the monostable multivibrator 24B is a 100 microsecond pulse which provides a signal to the counter/memory circuit 28 for purposes of counting the detected bowling pins 14. The leading edge of the pulse is used by the counter/memory circuit 28 for counting the bowling pins 14. The trailing edge of the pulse triggers a monostable multivibrator 24D which sets a status latch 24E. The monostable multivibrator 24D produces an output signal that is approximately one second in duration. This output disables the resetting of the status latch 24E which prevents bowling pins 14 from being counted before the present pin 14 moves away from the pin counter 10 and which also prevents small objects from falsely triggering the receiver 22. Once the input signal to the monostable multivibrator 24D goes low and the output signal of the monostable multivibrator 24D goes low, the status latch 24E is reset and the counter/memory circuit 28 is ready to count another bowling pin 14.

The pulse generated by the monostable multivibrator 24B is sent to a counting mechanism 28A of the counter/memory circuit 28. If the counting mechanism 28A is enabled by the status latch 24E being in the reset condition, the pulse signal steps the counting mechanism 28A up one position. When ten pulses have been recorded (which represents ten bowling pins 14 being detected) the counting mechanism 28A will be rest to zero at which time the output Q0 of the counting mechanism 28A will be set at a high logic level. This high logic level signal, which causes a zero LED to be turned on, is then sent to the output driver 30.

When the output driver 30 receives the high logic level signal, a first transistor 30A is turned off and a second transistor 30B is activated. This places the pin counter 10 in a static condition once ten bowling pins 14 have been detected.

Figure 3:
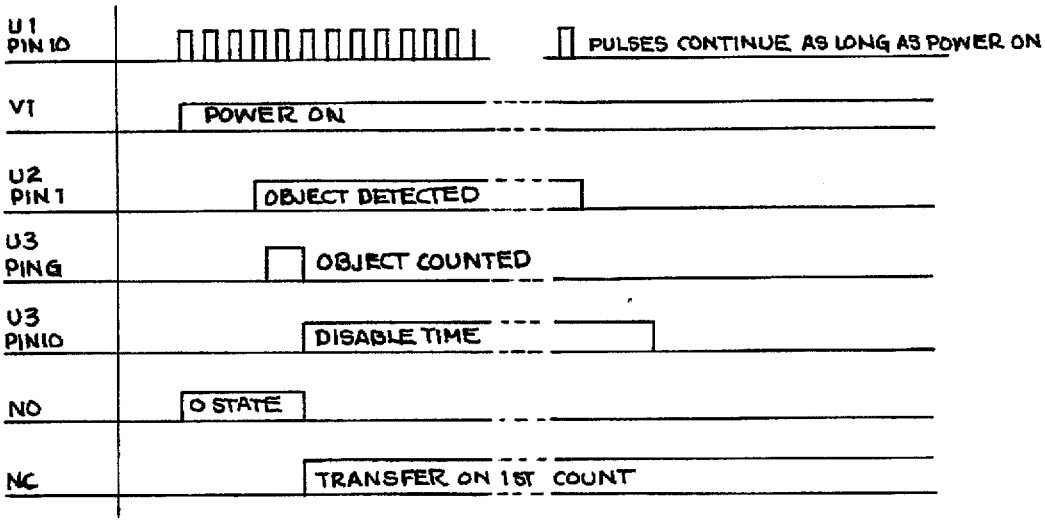
FIG. 3 is a timing diagram showing various signals during operation.
Figure 4:
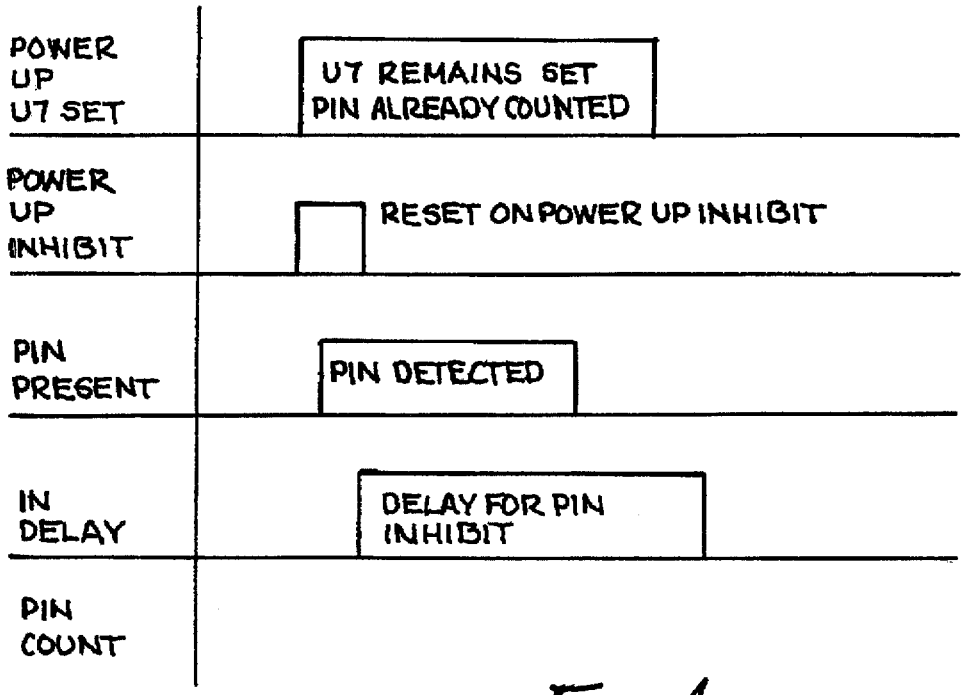
FIG. 4 is a timing diagram of power up conditions with a bowling pin in front of the solid state bowling pin counter that has already been counted.
Figure 5:
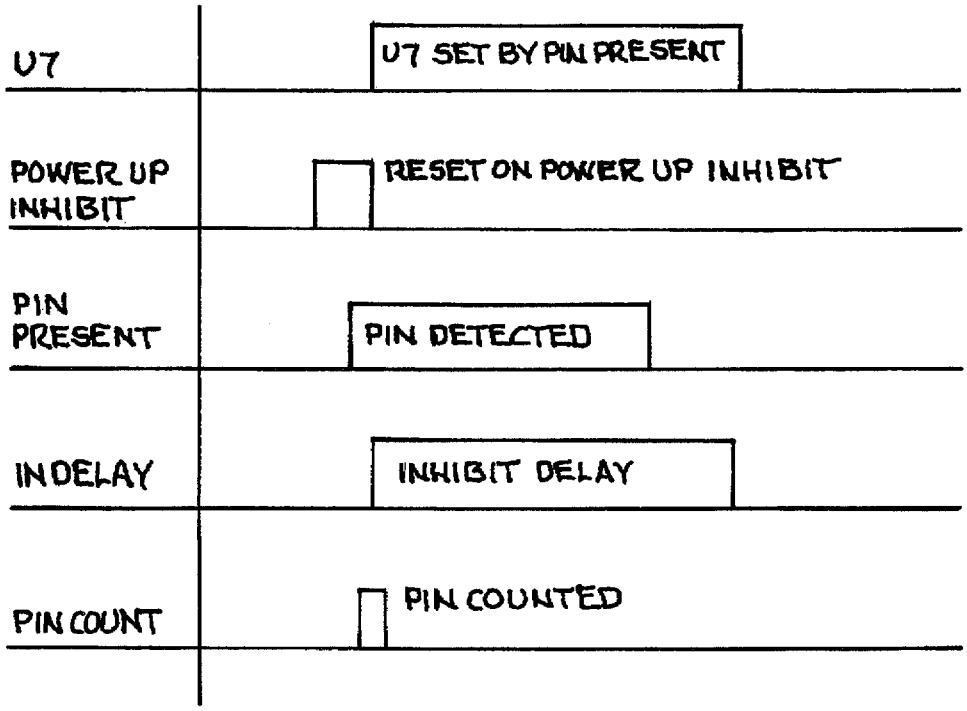
FIG. 5 is a timing diagram of power up conditions with a bowling pin in front of the solid state bowling pin counter that has not been counted.

The timing diagrams shown in FIGS. 3, 4, and 5 are shown to assist in the understanding of the operation of the pin counter 10 (see FIGS. 1 and 6). FIGS. 4 and 5 are of particular interest when examining power turn on conditions. Note that when a bowling pin 14 (see FIG. 1) is in front of the pin counter 10 and it has already been counted, when the power is turned back on this bowling pin 14 is not counted a second time. Further note that if a bowling pin 14 drifts into the detection range of the pin counter 10 when the power to the pin counter is off, when the power is turned back on, the bowling pin 14 will be counted.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A bowling pin counter for detecting and counting bowling pins regardless of color comprising, in combination:

transmitter means for transmitting pulses of electromagnetic emissions to detect said bowling pins;

receiving means coupled to said transmitter means for receiving reflected pulses of electromagnetic emissions when said transmitted pulses of electromagnetic emissions are reflected off of said bowling pins and for amplifying said reflected pulses of electromagnetic emissions to allow detection of colored bowling pins that have reflected wavelengths that are less than a wavelength of said transmitted pulses of electromagnetic emissions;

processing means coupled to said receiving means for stretching said amplified reflected pulses to provide an output signal for as long as said reflected pulses are received, said processing means having means coupled to said output signal for preventing a successive bowling pin from being counted until a current bowling pin moves away from said transmitter means and which prevents small objects from falsely triggering said receiving means;

counter/memory means coupled to said processing means for counting said bowling pins by detecting said output signal from said processing means;

output means coupled to said counter/memory means for receiving a signal from said counter/memory means when a predetermined number of bowling pins has been detected and for placing said bowling pin counter in a static condition once said predetermined number of bowling pins has been detected; and power supply means coupled to said transmitter means, said receiving means, said processing means, said counter/memory means, and said output means for converting an inputted power source Voltage Alternating Current (VAC) to an operating Voltage Direct Current (VDC) wherein said VDC is used to power said transmitter means, said receiving means, said processing means, said counter/memory means, and said output means.

2. A bowling pin counter for detecting and counting bowling pins regardless of color in accordance with claim 1 wherein said electromagnetic emissions are infrared emissions.

3. A bowling pin counter for detecting and counting bowling pins regardless of color in accordance with claim 2 wherein said transmission means comprises:

pulse generator means for producing said pulses of infrared emissions; and power driver means coupled to said pulse generator means for emitting said pulses of infrared emissions to detect said bowling pins.

4. A bowling pin counter for detecting and counting bowling pins regardless of color in accordance with claim 3 wherein said pulse generator means produces said pulses of infrared emissions having a length of about 23 microseconds and a pulse repetition rate of about 200 pulses per second.

5. A bowling pin counter for detecting and counting bowling pins regardless of color in accordance with claim 2 wherein said receiving means comprises:

photo transistor means for receiving said reflected pulses of infrared emissions when said transmitted pulses of electromagnetic emissions are reflected off of said bowling pins; and amplifier means coupled to said photo transistor means for amplifying said received reflected pulses of infrared emissions.

6. A bowling pin counter for detecting and counting bowling pins regardless of color in accordance with claim 5 wherein said photo transistor means has a crossover sensitivity that ranges from about 700 nanometers to about 1000 nanometers thereby detecting colored bowling pins that provide reflected wavelengths that are less than said wavelength of said transmitted pulses of infrared emissions.

7. A bowling pin counter for detecting and counting bowling pins regardless of color in accordance with claim 2 wherein said processing means comprises:

first monostable multivibrator means for providing an elongated pulse signal to said counter/memory means for counting said bowling pins;

threshold detector means coupled to said first monostable multivibrator means and to said receiving means for activating said first monostable multivibrator means when said amplified reflected pulses have a length greater than a preset threshold value;

latch means coupled to said counter/memory means for preventing said successive bowling pin from being counted until said current bowling pin moves away from said transmitter means and for preventing small objects from falsely triggering said receiving means;

second monostable multivibrator means coupled to said first monostable multivibrator means for providing a signal which sets and disables resetting of said latch means until said current bowling pin moves away from said transmitter means.

8. A bowling pin counter for detecting and counting bowling pins regardless of color in accordance with claim 7 wherein said first monostable multivibrator means provides an elongated pulse signal having a length of about 100 microseconds.

9. A bowling pin counter for detecting and counting bowling pins regardless of color in accordance with claim 7 wherein a leading edge of said elongated pulse signal is used by said counter/memory means for counting said bowling pins.

10. A bowling pin counter for detecting and counting bowling pins regardless of color in accordance with claim 2 wherein said counter/memory means resets to zero once a predetermined number of bowling pins has been detected.

11. A bowling pin counter for detecting and counting bowling pins regardless of color in accordance with claim 2 wherein said counter/memory means comprises memory capacitor means for storing power so that contents in said counter/memory means will remained stored in said counter/memory means when power is turned off to said counter/memory means.

12. A bowling pin counter for detecting and counting bowling pins regardless of color in accordance with claim 2 wherein said power supply means provides about 5.5 VDC.

13. A bowling pin counter for detecting and counting bowling pins regardless of color comprising, in combination:

transmitter means for transmitting pulses of infrared emissions to detect said bowling pins, said transmitter means comprising:

pulse generator means for producing pulses of infrared emissions having a length of about 23 microseconds and a pulse repetition rate of about 200 pulses per second;

power driver means coupled to said pulse generator means for emitting said pulses of infrared emissions to detect said bowling pins;

receiving means coupled to said transmitter means for receiving reflected pulses of infrared emissions when said transmitted pulses of electromagnetic emissions are reflected off of said bowling pins and for amplifying said reflected pulses of infrared emissions to allow detection of colored bowling pins that have reflected wavelengths that are less than a wavelength of said transmitted pulses of infrared emissions, said receiving means comprising:

photo transistor means for receiving reflected pulses of infrared emissions when said transmitted pulses of electromagnetic emissions are reflected off of said bowling pins, said photo transistor having a cross-over sensitivity that ranges from about 700 nanometers to about 1000 nanometers thereby detecting colored bowling pins that provide reflected wavelengths that are less than said wavelength of said transmitted pulses of infrared emissions;

amplifier means coupled to said photo transistor means for amplifying said received reflected pulses of infrared emissions to allow detection of colored bowling pins that have reflected wavelengths that are less than said wavelength of said transmitted pulses of infrared emissions;

processing means coupled to said receiving means for stretching said amplified reflected pulses to provide an output signal for as long as said reflected pulses are received, said output signal setting a latch mechanism which prevents a successive bowling pin from being counted until a current bowling pin moves away from said transmitter means and which prevents small objects from falsely triggering said receiving means, said processing means comprising:

first monostable multivibrator means for providing an elongated pulse signal having a length of 100 microseconds to said counter/memory means for counting said bowling pins;

threshold detector means coupled to said first monostable multivibrator means and to said receiving means for activating said first monostable multivibrator means when said amplified reflected pulse have a length greater than a preset threshold value;

latch means coupled to said counter/memory means for preventing said successive bowling pin from being counted until said current bowling pin moves away from said transmitter means and for preventing small objects from falsely triggering said receiving means;

second monostable multivibrator means coupled to said first monostable multivibrator means for providing a signal which sets and disables resetting of said latch means until said current bowling pin moves away from said transmitter means;

counter/memory means coupled to said processing means for counting said bowling pins by detecting said output signal from said processing means, said counter/memory means resetting to zero once a predetermined number of bowling pins has been detected;

output means coupled to said counter/memory means for receiving a signal from said counter/memory means when a predetermined number of bowling pins has been detected and for placing said bowling pin counter in a static condition once said predetermined number of bowling pins has been detected; and power supply means coupled to said transmitter means, said receiving means, said processing means, said counter/memory means, and said output means for converting an inputted power source Voltage Alternating Current (VAC) to an operating Voltage Direct Current (VDC) wherein said VDC is used to power said transmitter means, said receiving means, said processing means, said counter/memory means, and said output means.

14. A method of providing a bowling pin counter for detecting and counting bowling pins regardless of color comprising the steps of:

providing transmitter means for transmitting pulses of electromagnetic emissions to detect said bowling pins;

providing receiving means coupled to said transmitter means for receiving reflected pulses of electromagnetic emissions when said transmitted pulses of electromagnetic emissions are reflected off of said bowling pins and for amplifying said reflected pulses of electromagnetic emissions to allow detection of colored bowling pins that have reflected wavelengths that are less than a wavelength of said transmitted pulses of electromagnetic emissions;

providing processing means coupled to said receiving means for stretching said amplified reflected pulses to provide an output signal for as long as said reflected pulses are received, said processing means having means for preventing a successive bowling pin from being counted until a current bowling pin moves away from said transmitter means and which prevents small objects from falsely triggering said receiving means;

providing counter/memory means coupled to said processing means for counting said bowling pins by detecting said output signal from said processing means, said counter/memory means resetting to zero once a predetermined number of bowling pins has been detected;

providing output means coupled to said counter/memory means for receiving a signal from said counter/memory means when a predetermined number of bowling pins has been detected and for placing said bowling pin counter in a static condition once said predetermined number of bowling pins has been detected; and providing power supply means coupled to said transmitter means, said receiving means, said processing means, said counter/memory means, and said output means for converting an inputted power source Voltage Alternating Current (VAC) to an operating Voltage Direct Current (VDC) of about 5.5 VDC wherein said 5.5 VDC is used to power said transmitter means, said receiving means, said processing means, said counter/memory means, and said output means.

15. The method of claim 14 wherein said electromagnetic emissions are infrared emissions.

16. The method of claim 15 wherein said step of providing said transmission means further comprises the steps of:

providing pulse generator means for producing said pulses of infrared emissions; and providing power driver means coupled to said pulse generator means for emitting said pulses of infrared emissions to detect said bowling pins.

17. The method of claim 16 wherein said pulse generator means produces said pulses of infrared emissions having a length of about 23 microseconds and a pulse repetition rate of about 200 pulses per second.

18. The method of claim 15 wherein said step of providing receiving means further comprises the steps of:

providing photo transistor means for receiving said reflected pulses of infrared emissions when said transmitted pulses of electromagnetic emissions are reflected off of said bowling pins; and providing amplifier means coupled to said photo transistor means for amplifying said received reflected pulses of infrared emissions.

19. The method of claim 18 wherein said photo transistor means has a crossover sensitivity that ranges from about 700 nanometers to about 1000 nanometers thereby detecting colored bowling pins that provide reflected wavelengths that are less than said wavelength of said transmitted pulses of infrared emissions.

20. The method of claim 15 wherein said processing means further comprises the steps of:

providing first monostable multivibrator means for providing an elongated pulse signal to said counter/memory means for counting said bowling pins;

providing threshold detector means coupled to said first monostable multivibrator means and to said receiving means for activating said first monostable multivibrator means when said amplified reflected pulse have a length greater than a preset threshold value;

providing latch means coupled to said counter/memory means for preventing said successive bowling pin from being counted until said current bowling pin moves away from said transmitter means and for preventing small objects from falsely triggering said receiving means;

providing second monostable multivibrator means coupled to said first monostable multivibrator means for providing a signal which sets and disables resetting of said latch means until said current bowling pin moves away from said transmitter means.

21. The method of claim 20 wherein said first monostable multivibrator means for providing an elongated pulse signal has a length of about 100 microseconds.

22. The method of claim 20 wherein a leading edge of said elongated pulse signal is used by said counter/memory means for counting said bowling pins.

23. The method of claim 15 wherein said step of providing counter/memory means further comprises the step of providing memory capacitor means for storing power so that contents in said counter/memory means will remained stored in said counter/memory means when power is turned off to said counter/memory means.

* * * * *